US009803579B2

(12) United States Patent
Heitz et al.

(10) Patent No.: US 9,803,579 B2
(45) Date of Patent: Oct. 31, 2017

(54) METHOD FOR ADAPTING A COMMON-RAIL INJECTION SYSTEM OF AN INTERNAL COMBUSTION ENGINE

(71) Applicant: Robert Bosch GmbH, Stuttgart (DE)

(72) Inventors: Daniel Heitz, Rutesheim (DE); Peter Landgraf, Herrenberg (DE); Holger Rapp, Ditzingen (DE); Traugott Degler, Korntal (DE); Lars Engelfried, Stuttgart (DE); Thomas Becker, Esslingen/Zell (DE)

(73) Assignee: ROBERT BOSCH GMBH, Stuttgart (DE)

( * ) Notice: Subject to any disclaimer, the term of this patent is extended or adjusted under 35 U.S.C. 154(b) by 150 days.

(21) Appl. No.: 14/833,797

(22) Filed: Aug. 24, 2015

(65) Prior Publication Data

US 2016/0061137 A1 Mar. 3, 2016

(30) Foreign Application Priority Data

Aug. 28, 2014 (DE) ..... 10 2014 217 112

(51) Int. Cl.
*F02D 41/24* (2006.01)
*F02D 41/38* (2006.01)

(52) U.S. Cl.
CPC ..... *F02D 41/248* (2013.01); *F02D 41/2445* (2013.01); *F02D 41/2467* (2013.01); *F02D 41/2477* (2013.01); *F02D 41/3836* (2013.01); *F02D 2200/0602* (2013.01)

(58) Field of Classification Search
CPC ..... F02D 41/248; F02D 41/2445; F02D 41/2467; F02D 2200/0602; F02D 41/2477; F02D 41/3836
See application file for complete search history.

(56) References Cited

U.S. PATENT DOCUMENTS 5,491,631 A * 2/1996 Shirane ..... F02D 41/22 123/479
5,755,212 A * 5/1998 Ajima ..... F02D 41/1405 123/674
6,543,220 B2 * 4/2003 Yoshida ..... F02D 41/042 60/274
6,725,826 B2 * 4/2004 Esteghlal ..... F02D 41/2441 123/295
6,988,030 B2 * 1/2006 Asano ..... F02D 41/1498 123/436
7,111,455 B2 * 9/2006 Okugawa ..... F01N 3/0253 60/285
7,305,967 B1 * 12/2007 Hagari ..... F02D 9/02 123/403

(Continued)

FOREIGN PATENT DOCUMENTS

JP 2011-153608 * 8/2011 ..... Y02T 10/42

*Primary Examiner* — Joseph Dallo
(74) *Attorney, Agent, or Firm* — Norton Rose Fulbright US LLP; Gerard Messina

(57) ABSTRACT

In a method for adapting at least one injector of an injection system, in particular of a common-rail injection system of an internal combustion engine of a motor vehicle, where injections take place based on a characteristics map with at least two input variables and at least one output variable, a transition is carried out into a learning mode in which only discrete values are permitted for one of the at least two input variables of the characteristics map.

13 Claims, 2 Drawing Sheets

(56) References Cited

U.S. PATENT DOCUMENTS

| | | | | |
|---|---|---|---|---|
| 7,578,288 | B2 * | 8/2009 | Thiel | F02D 41/1402<br>123/688 |
| 7,650,226 | B2 * | 1/2010 | Ishizuka | F02D 41/2467<br>123/434 |
| 7,891,337 | B2 * | 2/2011 | Takeuchi | F02D 41/1497<br>123/436 |
| 8,215,288 | B2 * | 7/2012 | Gwidt | F02D 41/22<br>123/447 |
| 8,219,302 | B2 * | 7/2012 | Yamashita | F02D 41/2438<br>701/106 |
| 2002/0139360 | A1 * | 10/2002 | Sato | F02D 41/0037<br>123/698 |
| 2003/0164166 | A1 * | 9/2003 | Takeuchi | F02D 41/0085<br>123/674 |
| 2003/0233997 | A1 * | 12/2003 | Kawaguchi | F02D 41/0085<br>123/299 |
| 2005/0092303 | A1 * | 5/2005 | Oki | F02D 41/0087<br>123/480 |
| 2009/0063022 | A1 * | 3/2009 | Ishizuka | F02D 41/2467<br>701/106 |

* cited by examiner $p_{ist} = p_{actual}$ $Ad_{korr} = Ad_{correction}$

METHOD FOR ADAPTING A COMMON-RAIL INJECTION SYSTEM OF AN INTERNAL COMBUSTION ENGINE

FIELD OF THE INVENTION

The present invention relates to a method for adapting at least one injector of an injection system, in particular of a common-rail injection system of an internal combustion engine of a motor vehicle. The present invention also relates to a computer program, a machine-readable data carrier for storing the computer program, and an electronic control device with the aid of which the method according to the present invention can be carried out.

BACKGROUND

In a common-rail injection system, the activation period of at least one injector which is necessary for the desired injection quantity is ascertained as a function of a desired injection quantity and a measured fuel pressure in the rail (the so-called rail pressure) via an activation period characteristics map. In addition, the setpoint value of the rail pressure is predefined in such a way that it is continuously adjustable via a rail pressure characteristics map as a function of the desired main injection quantity and the rotational speed of the internal combustion engine.

The activation period characteristics map corresponds to an average or mean-valued injector, so that only an exactly mean-valued injector will precisely inject the desired fuel quantity during the activation in the case of the activation period ascertained on the basis of the activation period characteristics map.

In order to adapt or compensate for manufacturing tolerances of injectors, versus an above-mentioned mean-valued injector, as well as, for example, age-related changes in the injection behavior over their service lives, the different approaches or functions described in the following are known to be available.

In order to adapt quantity variances in the new condition of an injector, a so-called injector fuel-quantity compensation is carried out. In this case, the actually injected fuel quantity is individually measured for each injector at different points of the activation period characteristics map and their deviation from a setpoint quantity of a mean-valued injector is determined. The measured values of the deviation are, for example, alphanumerically coded and this code is attached to the injector. During the manufacture of an internal combustion engine, this code is read into a control device of the internal combustion engine and decoded. Quantity deviation values present at discrete check points or base points are interpolated or extrapolated across the entire activation period characteristics map. The above-mentioned deviations of the injection quantity are therefore known for each injector or cylinder of the internal combustion engine and may thus be adapted or compensated for. An injector fuel-quantity compensation, however, does not allow for the compensation for the above-mentioned changes over the service life.

With the aid of a learning function of the so-called "zero fuel compensation" (ZFC) which is known per se, a quantity drift may be adapted over the service life in a very limited characteristics map area of an above-mentioned activation period characteristics map. This function includes certain learning period areas, exclusively time intervals in the coasting mode of the internal combustion engine being used in which a quantity intended by the driver equals zero. In an operating state of this type, a certain learning value is set for the rail pressure and the injector of a cylinder is in this case activated at a very short activation period. This activation period is varied until a predetermined injection quantity may be inferred from the rotational speed progression of the internal combustion engine. In this way, it is possible to retrace and adapt or compensate for the change in the activation period which results over the service life and which is necessary for the injection of the predetermined injection quantity. The disadvantage is that the learning mode and the application of a learned activation period is limited to very small injection quantities so that if an injection quantity >0 is desired by the driver, the learning cycle must be interrupted immediately in most cases and a transition into the normal driving operation must take place.

Another approach to adapting an injection system depends on the basis for compensating for torque inequalities between individual cylinders of the internal combustion engine (so-called "fuel balance control"=FBC), which mainly originates in the air system or in the mechanical components of the internal combustion engine. In this case, this compensation takes place with the aid of pure controllers.

Moreover, sensor systems for detecting the injection start and the injection end of a fuel injection or for measuring the combustion chamber pressure are already being developed today. It will thus be possible to control the injection quantity significantly more accurately than before, it being necessary, however, to stationarily set the working point for the control for a preferably long period of time. Working points of this type, however, change constantly and rapidly in a motor vehicle so that it will also be necessary in systems of this type to ascertain preferably accurate information about the general deviation of the behavior of an individual injector from that of an above-mentioned mean-valued injector in order to use this information in the form of a pilot control of the activation period or a variable associated with the latter.

SUMMARY

In this case, it is meaningful to ascertain simple parameters using which the data of a characteristics map, which is adapted to a mean-valued injector, may be adapted to the particular injector with the aid of multiplicative and/or additive corrections. In this way, the controller for the injection quantity and the injection duration is considerably relieved during dynamic operation and the metering accuracy is considerably increased.

When ascertaining the above-mentioned parameters, a characteristics map to be adapted or corrected is usually spanned over two input variables, a setpoint injection duration and an injection pressure in the case of a common-rail injection system, for example. In order for the associated measured values to be ascertained in the entire characteristics map area, these measurements are to take place during normal operation of an internal combustion engine or during normal driving operation of a motor vehicle including such an internal combustion engine, and the taking of the measurements are therefore not limited to a defined learning mode, e.g., a coasting mode of the internal combustion engine.

In the case of the above-mentioned ascertainment of the measured values, the difficulty thus arises that, during the above-mentioned combustion engine or driving operation, both input variables of the characteristics map to be adapted are adjusted continuously and it is thus not possible to assign the obtained measured values or their deviations from those values, which are to be expected in the case of exactly mean-valued injectors, to the base points or base positions stored in the characteristics map.

The present invention is therefore based on the idea of assigning the obtained measured values to unambiguously determined base position areas in the characteristics map to be able to ascertain therefrom adaption parameters for a preferably multiplicative and/or additive correction of the respective output variable of the characteristics map.

For this purpose, a method according to an example embodiment of the present invention, in particular, provides in the case of an above-mentioned adaption of at least one injector of a common-rail injection system of an internal combustion engine, a learning mode which permits only few discrete values for one of the input variables of the characteristics map, preferably for the rail pressure, or which adjusts only in discrete stages one of the input variables of the characteristics map, preferably the rail pressure.

According to a preferred example embodiment of the method according to the present invention, only those predefined values are used for the discrete stages for which base points are already provided in the associated characteristics map.

In an example embodiment, an additional requirement with regard to the adaption or correction itself is that an intervention into the operation or control of the internal combustion engine (e.g., into the engine management) which takes place on the basis of a correspondingly corrected output variable must be minor enough to not be noticed by the vehicle driver or at least not be considered to be disadvantageous or comfort-reducing.

Based on the method according to the present invention, the injected fuel quantity of a common-rail injector and thus, in particular, also an above-mentioned characteristic curve can be determined or adapted, or corrected more accurately.

In an example embodiment of the present invention, the method further includes ascertaining a value, which is to be provided during normal operation, of the one input variable, for which only discrete values are permitted in the learning mode, and that value which is closest to the thus ascertained value and which is permissible in the learning mode is determined as the setpoint value of this input variable. Based on the stage- or ramp-shaped characteristic curve resulting therefrom, the method can be implemented with relatively little effort.

In the case of the method according to the present invention, in an example embodiment, a hysteresis is provided at each switchover point of the above-mentioned discrete values of the input variable. In this way, it is possible to effectively avoid a frequent switchover between two discrete values, since the hysteresis loops alleviate the discrete character of the characteristic curve.

Individual characteristic curves ascertained with the aid of the method according to the present invention can be used to generate an entire characteristics map by simple accumulation or conflation.

In an example embodiment, a transition is carried out into the learning mode only if certain boundary conditions which may influence the behavior of the at least one injector of the injection system are within limits which are normal for the driving operation, thus ensuring that the learning mode is only activated if an adaption according to the present invention is possible during the driving operation at a sufficient degree of accuracy.

In an example embodiment, if the method according to the present invention is used for adapting an injector of a common-rail injection system, only discrete values are permitted for the rail pressure during the learning mode. In particular, only predefined, discrete values may be permitted for a setpoint value of the rail pressure in this case. The rail pressure is preferred as one of the input variables, since it is known to be accurately presettable using means which are already present in such an injection system, e.g., a fuel pump, a control valve, and a fuel pressure sensor.

The present invention can be used as an adaption or a correction function, in particular, in an above-mentioned common-rail injection system, the internal combustion engine being usable in a motor vehicle or in the field of chemical engineering or the like. Moreover, the present invention can also be used with the advantages described herein for injection systems which are not provided for injecting fuel and in the case of which an activation characteristics map is used, e.g., in an SCR injection system for reducing nitrogen oxides in the exhaust gas of an internal combustion engine.

According to an example embodiment, a computer program according to the present invention is configured to cause performance of every step of the method, in particular when it runs on an arithmetic unit or a control device. The computer program makes it possible to implement the method according to the present invention on an electronic control device without having to carry out structural changes on it. For this purpose, a machine-readable data carrier is provided on which the computer program according to the present invention is stored. By installing the computer program according to the present invention on an electronic control device, the electronic control device according to the present invention is obtained which is configured to control an injection system with the aid of the method according to the present invention.

Further advantages and embodiments of the present invention are derived from the description and the accompanying drawings.

It is understood that the above-mentioned features and the features to be elucidated below are usable not only in the given combination, but also in other combinations or alone without departing from the scope of the present invention.

DETAILED DESCRIPTION

Figure 1:
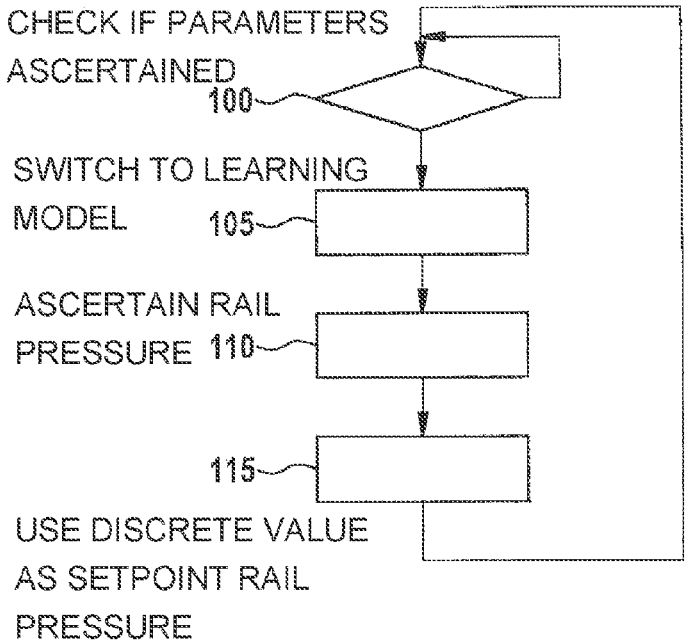
FIG. 1 is a flowchart that illustrates a method according to an example embodiment of the present invention.

The example embodiment illustrated in FIG. 1 of the method according to the present invention is described using the example of a characteristics map of a common-rail injection system of an internal combustion engine of a motor vehicle in which the activation period is stored as an output variable as a function of the desired injection duration and the rail pressure as input variables. It is understood that the principles described herein and the method described herein are in general also applicable in the case of other characteristics maps or in the case of other injection systems having corresponding characteristics maps.

It is initially checked 100 whether the correction parameters which are necessary for the adaption or correction of an individual injector have not been yet ascertained at all or must be re-ascertained, since a predefined maintenance interval was exceeded. If one of these conditions is met, the normal driving operation of the motor vehicle is switched to learning mode 105. In this example embodiment, the learning mode differs from the normal operation only in that the rail pressure is no longer predefined in such a way that it is continuously adjustable as a function of the desired injection quantity and the rotational speed of the internal combustion engine, but such that the setpoint value of the rail pressure may have only exactly predefined discrete values. These predefined values are preferably identical to the pressure values for which base points are already provided in the characteristics map which is to be adapted or subsequently corrected.

Figure 2:
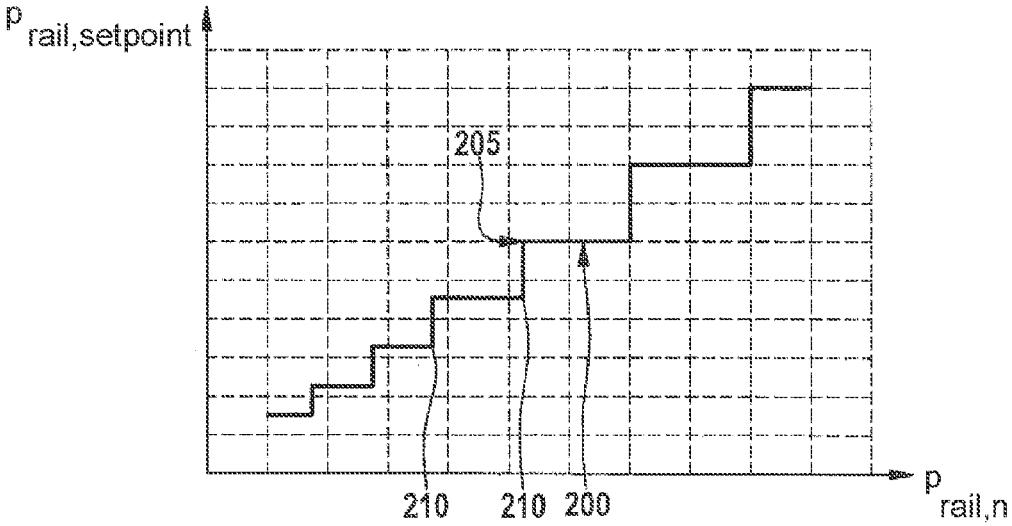
FIG. 2 shows, using the example of a rail pressure setpoint value, a connection between the setpoint value of a variable which is to be established for discrete values in a learning mode during normal operation (x axis) as well as during the learning mode (y axis), according to an example embodiment of the present invention.

The above-mentioned limitation to discrete values takes place according to the present example embodiment in that initially a rail pressure $p_{rail,n}$ (see FIG. 2, reference numeral 200) to be provided during normal driving operation is ascertained 110 and then the (discrete) value which is closest to it and which is permissible in the learning mode is determined and used 115 as rail pressure value $p_{rail,setpoint}$ (see FIG. 2, reference numeral 205).

Figure 3:
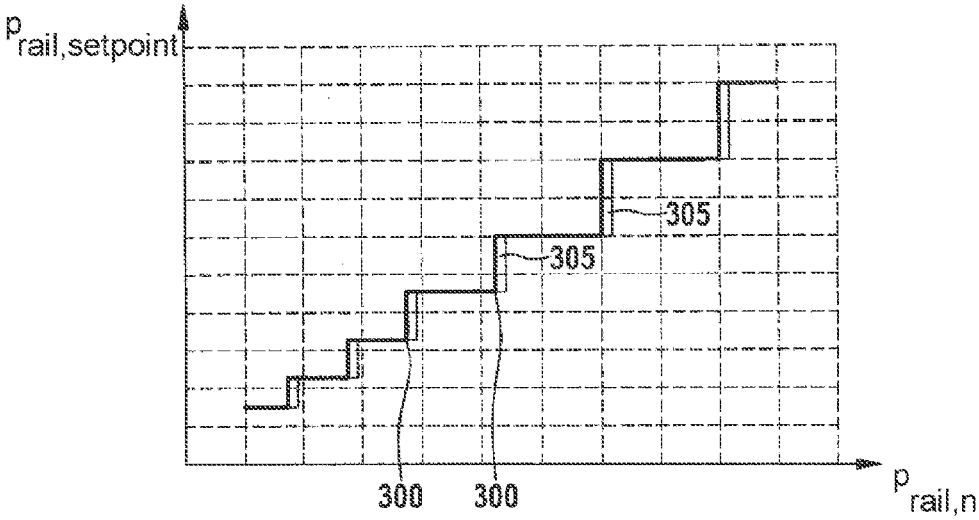
FIG. 3 shows a variant of the connection shown in FIG. 1 including an extension by the hysteresis loops provided at the switchover points, according to an example embodiment of the present invention.

In order to avoid a frequent switchover between two discrete rail pressure values, the characteristic curve shown in FIG. 2 and having the rail pressure setpoint value $p_{rail,n}$ during normal operation as the input variable (x axis) and the rail pressure setpoint value $p_{rail,setpoint}$ during learning mode as the output variable (y axis) can in each case be provided with a hysteresis 305 at switchover points 210, 300 (see FIG. 3).

In the described example embodiment, it is achieved overall that during the learning mode only the setpoint injection duration is still continuously adjusted and the measured values can be unambiguously assigned to a characteristic curve activation period=f (injection duration) at a fixed rail pressure in each case, the entire characteristics map possibly being made up of multiple characteristic curves of this type at discrete rail pressure values in each case.

Since the deviation between the rail pressure selected in the learning mode and that provided during normal operation is relatively small in each case if the stages of the characteristic curve shown in FIGS. 2 and 3 are accordingly fine and, in addition, the injected fuel quantity itself is not changed by the learning mode, the learning mode or the transition from normal operation to learning mode remains unnoticed by the vehicle driver and can thus be maintained in the driving operation until a sufficient amount of measured values for a precise adaption or subsequent correction of the characteristics map is available. It is thus possible to switch any time from normal mode to learning mode during the driving operation (see FIG. 1, reference numeral 105), if necessary, so that the learning mode is not limited to exceptional situations during the driving operation.

According to one variant, the learning mode is enabled only when certain boundary conditions, which may influence the injector behavior, are within limits that are normal for the driving operation so that measured values which are influenced by certain boundary conditions are not taken into consideration when correcting the characteristics map. The above-mentioned boundary conditions can be, for example, the cooling water temperature or the fuel temperature present in the internal combustion engine.

Figure 4:
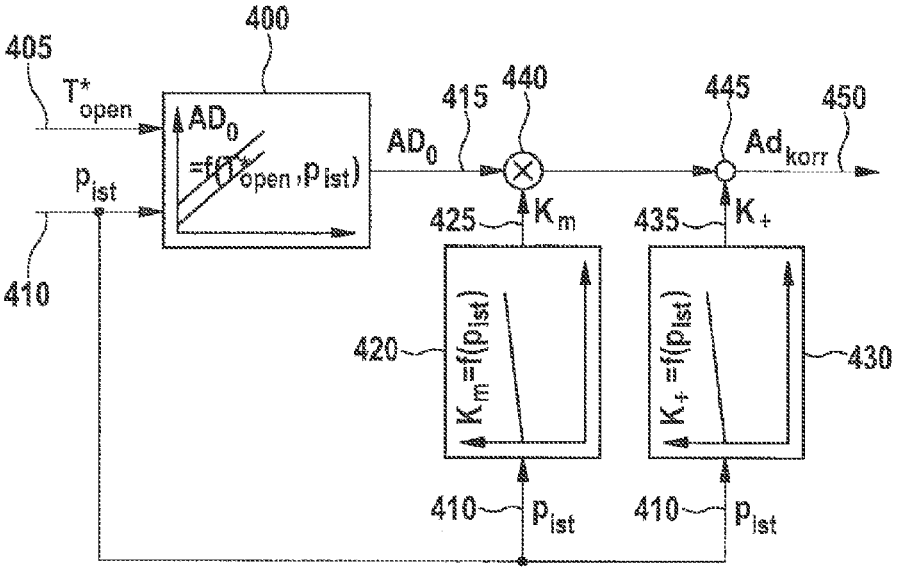
FIG. 4 shows an a processing structure of a pilot-controlled correction for adapting an individual injector behavior, according to an example embodiment of the present invention.

One example embodiment of a processing structure for subsequent multiplicative and additive correction of the output variable of a characteristics map is illustrated in FIG. 4. According to this structure, the activation period $AD_0$ 415 which is necessary for such an injector is initially ascertained on the basis of a two-dimensional application characteristics map 400 for a mean-valued injector from a setpoint value of injection duration $T_{open}$ 405 and an actual value of rail pressure $p_{rail,actual}$ 410. Subsequently, a multiplicative correction factor $K_m$ 425 is, in turn, determined as a function of the above-mentioned actual value of rail pressure $p_{rail,actual}$ 410 from a first adaption characteristic curve 420.

Furthermore, an additive correction factor $K_+$ 435 is also determined as a function of the actual value of rail pressure $p_{rail,actual}$ 410 from a second adaption characteristic curve 430.

Activation period $AD_{korr}$ 450 which is adapted to the individual injector behavior is computed on the basis of the two correction factors 425, 435 determined in this manner according to the relationship $[AD_{korr}=K_m*AD_0+K_+]$ with the aid of a multiplicative linking point 440 and an additive linking point 445. The base points of the first and the second adaption characteristic lines have been in this case determined beforehand based on the method according to the present invention, i.e., during the above-mentioned learning mode. Starting values for correction factors $K_m$ and $K_+$ prior to a learning process which is carried out for the first time are:

$$K_m(p_{rail,actual})=1 \text{ and}$$

$$K_+(p_{rail,actual})=0.$$

It is to be noted that the above-described learning mode may also be accordingly applied to determine adaption parameters for other variables than the ones described here as an example.

The method described above can be implemented in the form of a control program for an electronic control device for controlling an internal combustion engine or in the form of one or multiple corresponding electronic control units (ECUs).

What is claimed is:

1. A method for adapting at least one injector of an injection system of a motor vehicle, in which injections are performed based on a characteristics map that provides at least one output variable based on at least two input variables, the method comprising:

transitioning, by processing circuitry, into a learning mode in which only discrete values are permitted for one of the at least two input variables of the characteristics map; and updating, by the processing circuitry, the characteristics map during the learning mode; and adapting an activation period of the at least one injector of the injection system of the motor vehicle, in which injections are performed based on the characteristics map that provides the at least one output variable based on the at least two input variables.

2. The method of claim 1, wherein the transitioning is performed when correction parameters for the updating must be ascertained.

3. The method of claim 1, wherein one of the at least two input variables of the characteristics map is adjusted only in discrete stages.

4. The method of claim 3, wherein only predefined values for which discrete check points are provided in the characteristics map are used for the discrete stages.

5. The method of claim 1, further comprising:

ascertaining a value of the one input variable to be provided during normal operation, wherein, the updating includes setting whichever one of the permitted discrete values that is closest to an ascertained value as a setpoint value of the one input variable.

6. The method of claim 1, wherein a hysteresis is provided at each of a plurality of switchover points between respective pairs of the permitted discrete values.

7. The method of claim 1, wherein an entirety of the characteristics map is generated from multiple characteristic curves formed using discrete values of the one input variable.

8. The method of claim 1, wherein the transitioning is performed only if predefined boundary conditions, which can influence the behavior of the at least one injector of the injection system, are within limits predefined as normal for a driving operation.

9. The method of claim 1, wherein the injection system is a common-rail injection system of an internal combustion engine of a motor vehicle.

10. The method of claim 1, wherein the injection system is a common-rail injection system and the one variable is a rail pressure.

11. The method of claim 10, wherein the one variable is a setpoint value of the rail pressure.

12. A non-transitory computer-readable medium having a computer program, which is executable by a processor, comprising:

a program code arrangement having program code for adapting at least one injector of an injection system, in which injections are performed based on a characteristics map that provides at least one output variable based on at least two input variables, by performing the following:

transitioning into a learning mode in which only discrete values are permitted for one of the at least two input variables of the characteristics map; and updating the characteristics map during the learning mode; and adapting an activation period of the at least one injector of the injection system of the motor vehicle, in which injections are performed based on the characteristics map that provides the at least one output variable based on the at least two input variables.

13. An electronic control device comprising processing circuitry, wherein the processing circuitry is configured to perform a method for adapting at least one injector of an injection system, in which injections are performed based on a characteristics map that provides at least one output variable based on at least two input variables, the method comprising:

transitioning into a learning mode in which only discrete values are permitted for one of the at least two input variables of the characteristics map; and updating the characteristics map during the learning mode; and adapting an activation period of the at least one injector of the injection system of the motor vehicle, in which injections are performed based on the characteristics map that provides the at least one output variable based on the at least two input variables.

* * * * *